United States Patent [19]

Inoue

[11] 4,395,085

[45] Jul. 26, 1983

[54] WATERPROOF CONNECTOR

[75] Inventor: Nori Inoue, Yokkaichi, Japan

[73] Assignee: Tokai Electric Wire Company Limited, Yokkaichi, Japan

[21] Appl. No.: 265,689

[22] Filed: May 20, 1981

[30] Foreign Application Priority Data

May 23, 1980 [JP] Japan ..... 55/71794[U]

[51] Int. Cl.[3] ..... H01R 13/52

[52] U.S. Cl. ..... 339/94 R

[58] Field of Search ..... 339/89 R, 89 C, 89 M, 339/90 R, 90 C, 94 R, 94 M, 91 R, 60 M; 285/80, DIG. 19

[56] References Cited

U.S. PATENT DOCUMENTS

| | | | |
|---|---|---|---|
| 2,467,911 | 9/1982 | Reilly | 285/DIG. 19 X |
| 4,037,902 | 9/1982 | Miller | 339/89 M X |
| 4,304,456 | 9/1982 | Takaki | 339/89 M X |

*Primary Examiner*—Eugene F. Desmond
*Assistant Examiner*—David Pirlot
*Attorney, Agent, or Firm*—Cushman, Darby & Cushman

[57] ABSTRACT

A waterproof connector having a male and female housing parts adapted to fit each other and an "O" ring pressed between the male and female housing parts to effect a seal therebetween is disclosed. The male housing part has an inner sleeve on which the "O" ring is fitted and an outer sleeve having a larger diameter than the inner sleeve and substantially surrounding the latter, while the female housing part has a cylindrical wall defining an opening for receiving the male housing part. In the assembled state, the cylindrical wall of the female housing part is fitted in the gap between the inner sleeve and the outer sleeve of the male housing part, with the "O" ring pressed between the outer peripheral surface of the inner sleeve of the male housing part and the inner peripheral surface of the cylindrical wall of the female housing part.

1 Claim, 5 Drawing Figures

WATERPROOF CONNECTOR

BACKGROUND OF THE INVENTION

The present invention relates to a waterproof connector for electric wiring laid, for example, in automobiles.

As will be described in detail with reference to the drawings, a conventional waterproof connector has two housing parts which are assembled together with an "O" ring interposed therebetween. This "O" ring tends to be damaged during assembly of the connector leading to a deterioration of the sealing effect. In addition, burrs are likely to be formed on one of the housing parts along the parting line of split type molds which are used for forming the housing parts thereby requiring additional work for completely removing the burrs. If the burrs are not completely eliminated, the sealing effect of the "O" ring is further reduced.

SUMMARY OF THE INVENTION

Accordingly, an object of the invention is to provide a waterproof connector which is constructed to eliminate the danger of damaging the "O" ring.

Another object is to provide a waterproof connector which can be formed without leaving any burrs.

To these ends, according to the invention, there is provided a waterproof connector having a first and a second housing parts which are adapted to fit each other, one of the housing parts having a fitting portion constituted by an inner sleeve around which is wound an "O" ring made of an elastic member such as rubber and a large-diameter sleeve formed at a suitable distance from the inner sleeve. The other of the housing parts has a cylindrical wall adapted to be placed between the large-diameter sleeve and the inner sleeve of the first-mentioned housing part with the "O" ring pressed between the outer peripheral surface of the inner sleeve of one of the first-mentioned housing parts and the inner peripheral surface of the second-mentioned housing part.

The above and other objects as well as advantageous features of the invention will become more clear from the following description of the preferred embodiments taken in conjunction with the accompanying drawings.

DESCRIPTION OF THE PREFERRED EMBODIMENTS

Before turning to the description of the preferred embodiments of the invention, a typical conventional waterproof connector will be explained to facilitate the understanding of the drawbacks of the conventional connector and, hence, the advantage brought about by the present invention.

Figures 1, 2:
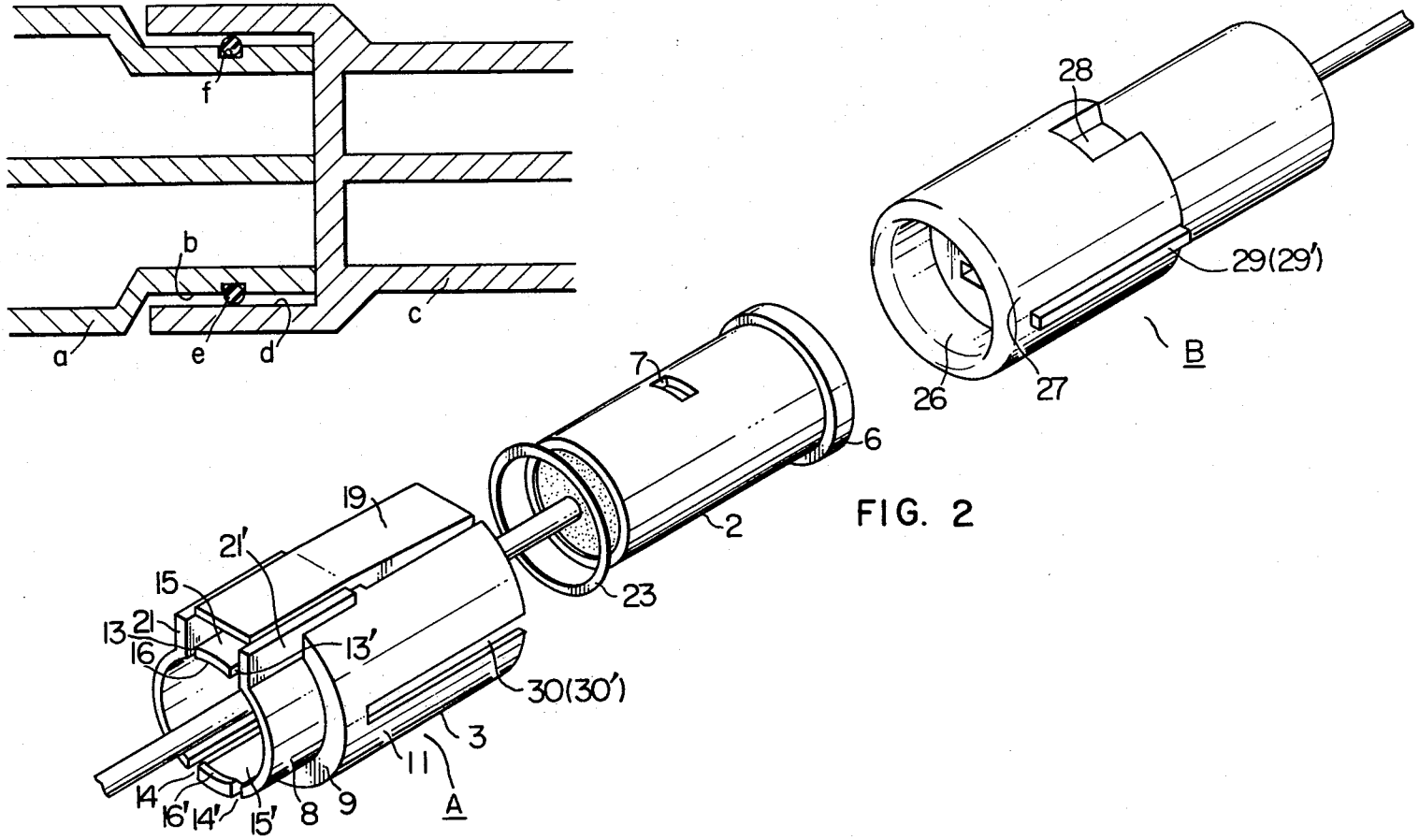
FIG. 1 PRIOR ART
FIG. 1 is a sectional view of a fitting portion of a conventional waterproof connector.
FIG. 2 is a perspective view of a waterproof connector in accordance with the invention.

Referring to FIG. 1, a typical conventional waterproof connector has a first or male housing part (a) and a second or female housing part (c). The seal between these housing parts is achieved by an "O" ring (e) interposed between the outer peripheral surface (b) of the housing (a) and the inner peripheral surface (d) of the housing part (c). Before the fitting of the male housing part (a) in the female housing (c), the "O" ring is always exposed to the outside so that the surface of the "O" ring tends to be damaged at its surface during the assembly of a wire harness of the electric wiring in an automobile or during attachment to the automobile chassis, resulting in a deterioration of the sealing effect in the seal between the fitting portions of both housing parts (a) and (c).

In the outer peripheral surface (b) of the housing part (a), is formed an annular recess (f) for receiving and fixing the "O" ring (e). Therefore, the housing part (a) is formed by means of a split type mold having two mold parts adapted to be brought together in the direction perpendicular to the axis of the housing part (a). In consequence, burrs are formed along the parting line of the split type mold, on the surface of the housing part (a) including the bottom of the annular recess (f) for receiving the "O" ring (e), in the axial direction of the housing part (a). Troublesome work is required for removing these burrs. If the burrs are not removed completely, the sealing effect of the "O" ring is seriously deteriorated.

This problem, however, is fairly avoided by the present invention as will be fully understood from the following description of the preferred embodiment.

Figure 3:
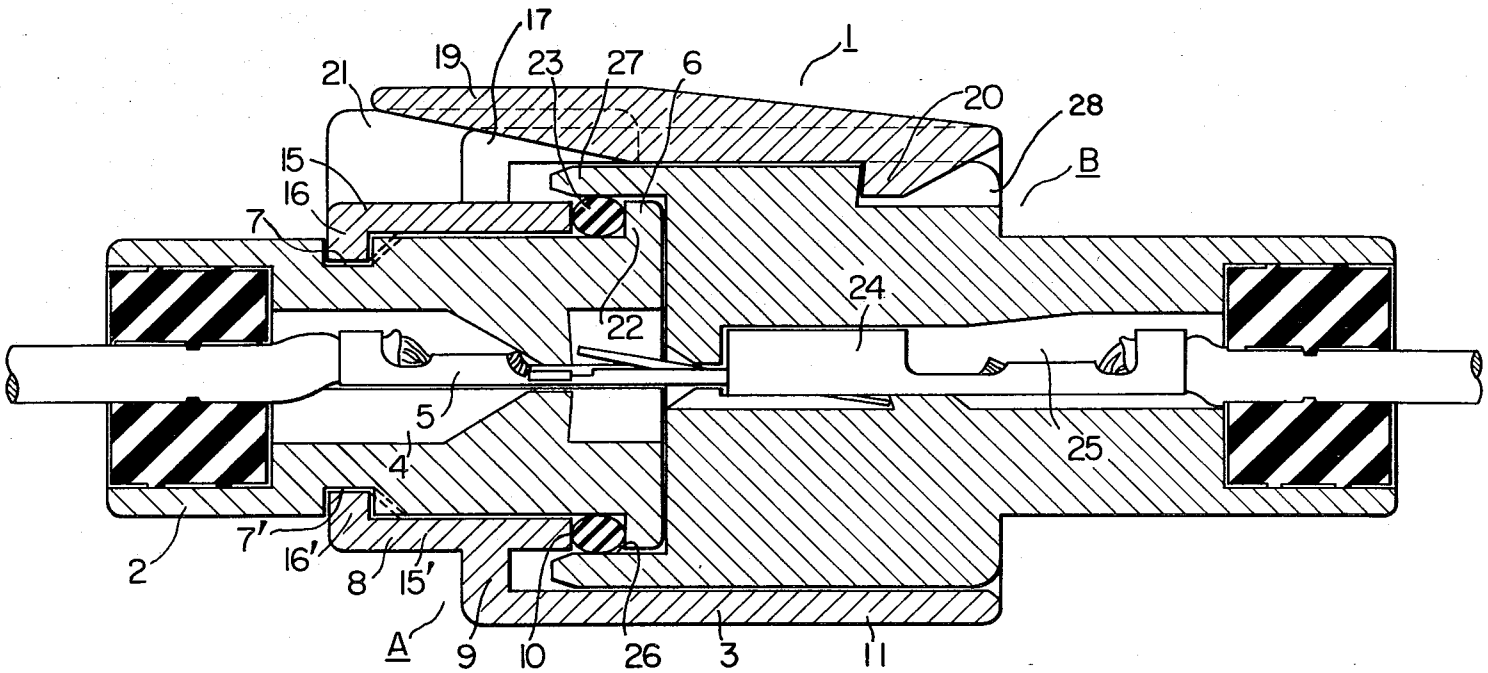
FIG. 3 is a sectional plan view of the waterproof connector shown in FIG. 2.

Hereinafter, a preferred embodiment of the invention will be described with reference to FIGS. 2 to 5. A waterproof connector in accordance with the invention has a male housing part (A) and a female housing part (B) which are adapted to fit each other. The male housing part (A) has an inner sleeve 2 and an outer sleeve 3 which are fitted to each other. The inner sleeve 2 has a chamber 4 for accommodating a male terminal 5 as shown in FIG. 3. An annular protrusion 6 is formed on the same end of the inner sleeve as the direction of projection of the male terminal 5. Recesses 7, 7' are formed in the peripheral surface of the midportion of the inner sleeve 2 in such a manner as to diametrically oppose to each other.

The inner sleeve 2 having the construction stated above can be formed by a split type mold having mold parts which are separable in the axial direction of the sleeve 2. Namely, it is possible to form the parting line of the mold parts on the peripheral surface of the annular protrusion 6, i.e., on a plane perpendicular to the axis of the annular protrusion 6.

The outer sleeve 3 is constituted of a small-diameter sleeve portion 8, having an inside diameter substantially equal to the outside diameter of the inner sleeve 2 and a thickness substantially equal to the projection length of the annular protrusion 6, and a large-diameter sleeve portion 11 connected to the peripheral wall of the midportion of the small-diameter sleeve 8 through an annular wall 9. The large-diameter sleeve portion 11 extends at a distance from the outer peripheral surface of the small diameter portion 8 axially beyond one open end 10 of the small-diameter sleeve 8.

Figure 4:
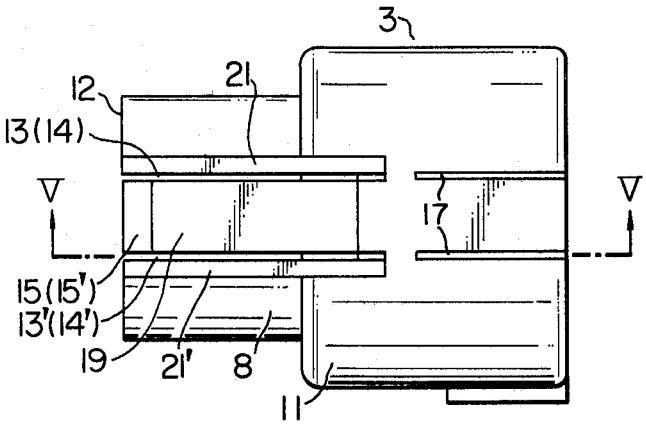
FIG. 4 is a plan view of a male housing part.
Figure 5:
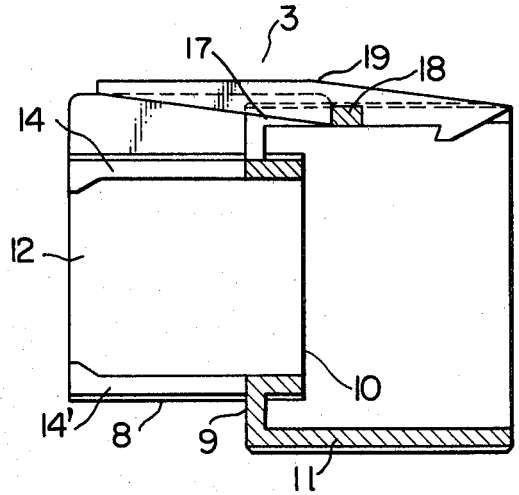
FIG. 5 is a sectional view taken along the line V—V of FIG. 4.

The small-diameter sleeve portion 8 has another open end 12 opposite to the first-mentioned end 10 as shown in FIG. 4. Slits 13, 13', 14, 14' are formed in the wall of the small-diameter sleeve portion 8 from the open end 12 to reach the base portion of the annular wall 9, thereby to leave cantilevered tabs 15, 15' which are spaced 180° from each other around the axis of the small-diameter sleeve portion 8. The free ends of these tabs 15, 15' are bent inwardly to form hooks 16, 16' as shown in FIG. 3.

The large diameter sleeve portion 11 has notches or grooves 17 extending from the annular wall 9 to the open end thereof along the tabs 15, 15'. An arm 19 having a fulcrum portion 18 extending between opposing surfaces of the groove 17 is disposed in the groove 17.

A hooked portion 20 is formed on the end of the arm 19 adjacent to the open end of the large-diameter sleeve portion 11, while the other end of the same is narrowed and thinned toward the outside. Reference numerals 21, 21' designate side walls extending between the ends of the slits 13, 13' of the small-diameter sleeve portion 8 adjacent to the body of the latter to the end of the groove 17 of the large-diameter sleeve portion 11.

In the assembled state of the male housing part, the inner sleeve 2 and the outer sleeve 3 are firmly anchored to each other with the hooks 16, 16' of the tabs 15, 15' of outer sleeve 3 engaged and received by the recesses 7, 7' of the inner sleeve 2 to prevent the outer sleeve 3 from being disengaged from the inner sleeve 2. Also, an annular recess 22 is formed between the open end 10 of the small-diameter portion 8 of the outer sleeve 3 and the annular protrusion 6 of the inner sleeve 2.

An "O" ring made of an elastic member such as rubber is wound around and received by the annular recess 22.

On the other hand, the female housing part B has a chamber 25 for accomodating a female terminal 24 of well-known type which includes a male terminal receptacle portion having a base plate and curved side walls each rising from one lateral end of the base plate and curved inwardly to have a free edge opposed with a small clearance to the upper surface of the base plate. An opening 26 for receiving the male housing A is formed to communicate with this chamber 25. The opening 26 is defined by a cylindrical wall 27 having an inside diameter substantially equal to the outside diameter of the annular protrusion 6 and an outside diameter substantially equal to the inside diameter of the large-diameter sleeve portion 11 of the outer sleeve 3.

Also, a recess 28 is formed in the outer peripheral surface of the female housing part B.

To assemble the male and female housing parts (A) and (B), these housing parts are brought together so that the cylindrical wall 27 of the female housing part B is forced into the gap between the small-diameter sleeve portion 8 and the large-diameter sleeve portion 11 of the male housing part (A) beyond the annular recess 22 of the latter, while the hook 20 of the arm 19 formed in the male housing part (A) is received and retained by the recess 28 of the female housing part (B). In this state, the "O" ring 23 wound around the annular recess 22 makes resilient contacts with the outer peripheral surface of the inner sleeve 2 and the inner peripheral surface of the cylindrical wall 27 of the female housing (B) to achieve an effective seal therebetween.

In the drawings, reference numerals 29, 29' denote protrusions or ridges formed on the outer peripheral surface of the female housing part (B) at a 180° interval around the axis of the female housing part (B), while numerals 30, 30' denote guide openings cut from the open end edge of the outer sleeve 3 and adapted to restrict the positional relationship between the two housing parts (B), (A) in the rotational direction.

As has been described, according to the invention, there is provided a waterproof connector constituted by male and female housing parts A and B adapted to fit each other, wherein the male housing part A has the inner sleeve 2 around which is wound an "O" ring 23 and a large diameter sleeve portion 11 which is radially spaced from the inner sleeve 2, while the female housing part B has a cylindrical wall 27 adapted to fit in the gap between the large-diameter sleeve portion 11 and the inner sleeve 2, with the "O" ring pressed between the outer peripheral surface of the inner sleeve 2 and the inner peripheral surface of the cylindrical wall 27. Therefore, the "O" ring 23 is never exposed to the outside before the assembling of the male and female housing parts A and B, so that the "O" ring is protected from any external damaging force during the assembling of the wire harness, as well as during the mounting of the harness on the automobile, to ensure a good sealing effect of the "O" ring.

It is also to be noted that, in the waterproof connector of the invention, the formation of burrs on the housing part (A) in the axial direction is completely avoided for the following reasons. Namely, the male housing part (A) of the waterproof connector of the invention is formed of an inner sleeve 2 and an outer sleeve 3 which are shaped as separate bodies. The inner sleeve 2 has an annular protrusion 6 formed on one open end thereof, while the outer sleeve 3 has a small-diameter sleeve portion 8 having an inside diameter substantially equal to the outside diameter of the inner sleeve 2 and a thickness substantially equal to the projection length of the annular protrusion 6, and a large-diameter sleeve portion 11 connected to the small-diameter sleeve portion 8 through an annular wall 9 and extending forwardly beyond the open end 10 of the small-diameter sleeve portion 8 at a predetermined radial distance from the latter. The annular recess 22 for receiving the "O" ring 23 is formed between the annular protrusion 6 of the inner sleeve 2 and the open end 10 of the small-diameter sleeve portion 8 of the outer sleeve 3. Therefore, it is possible to avoid the formation of burrs in the surface of the annular recess 22, which burrs have been inevitably formed on the surface of the annular recess 22 in the conventional connector along the parting line of the split mold. The elimination of the axial burrs on the surface of the annular recess 22 ensures a close fit of the "O" ring 23 in the latter to provide an enhanced sealing effect over the conventional waterproof connector.

As has been described, according to the invention, it is possible to obtain a waterproof connector which can provide a much superior sealing effect of the "O" ring, partly because the damaging of the surface of the "O" ring is avoided and partly because the axial burrs on the surface of the "O" ring receiving recess are eliminated.

What is claimed is:

1. A waterproof connector comprising:

a male housing part, a female housing part adapted to fit on said male housing part, and an "O" ring made of rubber or the like elastic material resiliently pressed between said housing parts, said male housing part having a fitting portion constituted by an inner sleeve around which said "O" ring is wound and a large-diameter sleeve portion which is formed at a predetermined radial distance from said inner sleeve, said female housing part having a cylindrical wall defining the opening for receiving said male housing part, said cylindrical wall being fitted in the gap between said inner sleeve and said large-diameter sleeve portion of said male housing part, said "O" ring being pressed between the outer peripheral surface of said inner sleeve and the inner peripheral surface of said cylindrical wall of said female housing part, said male housing part includes said inner sleeve and an outer sleeve formed as separate bodies, said inner sleeve having an annular protrusion formed on the outer periphery of one open end thereof, said outer sleeve including said large-diameter sleeve and a small-diameter sleeve portion having an inside diameter substantially equal to the outside diameter of said inner sleeve and a thickness substantially equal to the projection length of said annular protrusion, said large-diameter sleeve portion being connected to said small-diameter sleeve portion through an annular wall and being extended forwardly beyond an opening of said small-diameter sleeve portion with a predetermined radial distance from the latter, and said male housing part being provided with an annular recess for receiving said "O" ring between said annular protrusion of said inner sleeve and said open end of said small-diameter sleeve portion of said outer sleeve.

* * * * *